US006204353B1

(12) United States Patent
Eicken et al.

(10) Patent No.: US 6,204,353 B1
(45) Date of Patent: Mar. 20, 2001

(54) SPINNING FINISHES FOR SYNTHETIC FILAMENT FIBERS

(75) Inventors: Ulrich Eicken, Korschenbroich; Raymond Mathis, Dusseldorf; Norbert Bialas, Dormagen, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 08/117,013

(22) PCT Filed: Feb. 27, 1992

(86) PCT No.: PCT/EP92/00426

§ 371 Date: Sep. 7, 1993

§ 102(e) Date: Sep. 7, 1993

(87) PCT Pub. No.: WO92/15749

PCT Pub. Date: Sep. 17, 1992

(30) Foreign Application Priority Data

Mar. 7, 1991 (DE) ..... 41 07 283

(51) Int. Cl.[7] ..... C07C 69/34

(52) U.S. Cl. ..... 528/295.3; 528/295.5; 528/301; 528/306; 428/375; 560/198; 252/8.91; 106/231; 8/115.6

(58) Field of Search ..... 528/295.3, 295.5, 528/301, 306; 428/375; 560/198; 252/8.91; 106/231; 8/115.6; 525/418

(56) References Cited

U.S. PATENT DOCUMENTS

| | | | | |
|---|---|---|---|---|
| 3,725,352 | * | 4/1973 | Koleske | 528/301 |
| 4,062,907 | * | 12/1977 | Sublett | 528/301 |
| 4,525,575 | * | 6/1985 | Yeater | 528/301 |
| 4,725,500 | * | 2/1988 | Yanai et al. | 428/365 |
| 4,968,776 | * | 11/1990 | Fujita | 528/272 |

FOREIGN PATENT DOCUMENTS

| | | | | |
|---|---|---|---|---|
| 538843 | * | 3/1957 | (CA) | 528/301 |
| 1768313 | | 4/1971 | (DE) . | |
| 3830468 | | 3/1990 | (DE) . | |
| 0393665 | | 4/1990 | (EP) . | |
| 1172085 | | 11/1969 | (GB) . | |
| 1455091 | | 11/1976 | (GB) . | |
| 62006982 | | 7/1985 | (JP) . | |
| 63-235576 | | 9/1988 | (JP) . | |
| 02068367 | | 3/1990 | (JP) . | |
| 8908673 | * | 9/1989 | (WO) | 528/301 |

* cited by examiner

*Primary Examiner*—Rachel Gorr
(74) *Attorney, Agent, or Firm*—John E. Drach; Real J. Grandmaison

(57) ABSTRACT

The invention relates to spinning finishes containing a lubricant of improved biodegradability, the lubricant consisting of block copolyesters. The block copolyesters are produced from hydrophilic polyethylene glycols and hydrophobic diols selected from the group of polypropylene glycols, polytetrahydrofurans, polycaprolactone diols, hydrogenation products of ricinoleic acid esters, 1,2-alkanediols, α,ω-alkanediols and/or dimeric diols and dicarboxylic acids containing 2 to 36 carbon atoms connecting the blocks A) and B), anhydrides thereof, esters thereof with lower alcohols containing 1 to 8 carbon atoms and/or carbonic diesters of lower alcohols containing 1 to 8 carbon atoms.

18 Claims, No Drawings

SPINNING FINISHES FOR SYNTHETIC FILAMENT FIBERS

BACKGROUND OF THE INVENTION

1. Field of the Invention

This invention relates to spinning finishes for synthetic filament fibers containing as lubricant polyesters having hydrophilic and hydrophobic components in the molecule. The polyesters are block copolymers of hydrophilic polyethylene glycols and hydrophobic diols selected from the group consisting of polypropylene glycols, polytetrahydrofurans, polycaprolactone diols, hydrogenation products of ricinoleic acid esters, dimeric diols, 1,2-alkanediols and α,ω-alkanediols and polybasic carboxylic acids and/or derivatives thereof linking the polyethylene glycols and hydrophobic diols.

All synthetic manmade fibers are provided immediately after the filament-forming process with finishes which are essential for the subsequent processing of the fibers. These finishes, which are generally known in German as "Spinnpr äparationen (spinning finishes)" (cf. Ullmann Encyclopädie der technischen Chemie", Vol. 23, pages 7–9 Verlag Chemie, Weinheim 1983), provide the filaments wit the necessary surface slip between one another and between the filaments and the guide elements of the spinning machines. In addition to smoothness and filament compactness, fiber manufacturers generally expect spinning finishes to satisfy the following requirements: antistatic effect, good wetting of the filament, temperature stability, no metal corrosion, no deposits on stretching a texturing units, ready removability from the fibers a physiological harmlessness. Since the lubricants enter t wastewater during removal from the fibers, for example before dyeing, biodegradable lubricants are desirable.

2. Discussion of Related Art

The lubricants in spinning finishes are intended above all to provide the filaments with the necessary surface slip. At the same time, however, the lubricants must be temperature-stable, non-corrosive, readily removable from the fibers and physiologically harmless so that the requirements which the spinning finishes are required to meet can be satisfied. Typical lubricants for spinning finishes are vegetable, animal and mineral oils or even synthetic esters, silicones, polyethers, ethoxylated fatty acids and the like (cf. Ullmanns Encyclopädie der technischen Chemie, Vol. 23, pages 7–9, Verlag Chemie, Weinheim 1983).

In addition, spinning finishes for synthetic filament fibers should be capable of withstanding high temperatures such as occur in the texturing of polyester and polyamide fibers. Accordingly, so-called ester oils, i.e. esters of relatively high fatty acids with long-chain fatty alcohols, are often used as lubricants in such spinning finishes. According to Japanese patent publication JP-A-02/068367 (cf. Chemical Abstracts, Vol. 113:25510f), polyethylene oxide/polypropylene oxide block copolymers, so-called Pluronics®, may be used instead of the temperature-stable ester oils. Pluronics are capable of depolymerizing completely at relatively high temperatures. This is a particular advantage in texturing because deposits on filaments and texturing elements are avoided. However, fragments of the Pluronics, such as aldehydes, escape into the atmosphere during texturing, which can be harmful to human beings and the environment. In addition, Pluronics have the serious disadvantage that they are virtually non-biodegradable.

Spinning finishes for polyester fibers based or polyesters prepared from dicarboxylic acids, monocarboxylic acids and tetrahydrofuran/alkylene oxide random copolymer. are known from Japanese patent publication JP-A-63/23557 (cf. Chemical Abstracts, Vol. 110:156049y). However, these spinning finishes are also poorly biodegradable. According to Japanese patent publication JP-A-62/006982 (cf. Chemical Abstracts, Vol. 107:79426c), applied polyesters of terephthalic acid, ethylene oxide, propylene oxide and/or butylene oxide and, optionally, monocarboxylic acids or monohydric alcohols provide synthetic fibers with improved bindability and weavability. There is no reference to the significance of hydrophobic and hydrophilic components in the polyester molecule. In addition, the polyesters in question are exclusively polyesters based on aromatic terephthalic acid which is poorly biodegradable.

Polyesters containing hydrophilic and hydrophobic components in the molecule, which have been prepared from monoalcohols, dicarboxylic acids, secondary alcohols, polyethylene oxide and, optionally, polypropylene oxide, are known as emulsifiers in sizes containing epoxy resins for carbon fibers and glass fibers (cf. European patent application EP-A-03 93 665). According to the teaching of this patent application, it is crucial to the invention that the polyesters contain the polyethylene oxide units at the end of the polymer because it is only terminal polyethylene oxide units which are hydrophilic in character. In addition, these sizes of an epoxy resin and the polyesters are totally unsuitable as spinning finishes for synthetic fibers because the tacky epoxy resins would cause the synthetic filaments to adhere excessively to one another, resulting in filament breaks.

The problem addressed by the present invention was to provide spinning finishes for synthetic filament fibers which would contain lubricants having improved biodegradability. In addition, the lubricants would show good surface-slip properties by virtue of a hydrophobic component of the molecule and would readily be incorporable in water by virtue of a hydrophilic component of the molecule The lubricants would also be readily removable from the fibers and would show high temperature stability.

DESCRIPTION OF THE INVENTION

It has now surprisingly been found that spinning preparations containing block copolyesters which contain hydrophobic diols and hydrophilic polyethylene glycols interconnected by ester groups solve the stated problem.

Accordingly, the present invention relates to spinning finishes for synthetic filament fibers containing a lubricant having improved biodegradability, characterized in that the lubricant is a block copolyester prepared from the blocks A) polyethylene glycols having a weight average molecular weight of 450 to 20,000 and B) hydrophobic diols selected from the group of polypropylene glycols, polytetrahydrofurans, polycaprolactone diols, hydrogenation products of ricinoleic acid esters, 1,2-alkanediols, α,ω-alkanediols and/or dimeric diols and aliphatic $C_{2-36}$ dicarboxylic acids connecting the blocks A) and B), anhydrides thereof, esters thereof with lower $C_{1-8}$ alcohols and/or carbonic acid diesters of lower $C_{1-8}$ alcohols.

The block copolyesters present in accordance with the invention are prepared by esterification or transesterification of the carbonic acid diesters, the dicarboxylic acids, esters thereof and/or anhydrides thereof with the hydrophilic polyethylene glycols (block A) and the hydrophobic diols (block B), preferably in the presence of an esterification catalyst and with removal of the water of reaction formed, if any, and the released alcohol of the ester. General information on the conduct of an esterification reaction can be found, for example, in Ullmann's Encyclopädie der technischen Chemie, Vol. 91 (1980), Verlag Chemie, Weinheim, pages 91–96.

According to the invention, polyethylene glycols having an average molecular weight of 450 to 20,000, preferably 600 to 3,000 and, more preferably, 800 to 2,000, are used as hydrophilic diols (block A) in the synthesis of the block copolyesters. Polyethylene glycols are commercially available products and are industrially obtained, for example, by the base-catalyzed action of alcoholate anions on ethylene oxide with ring opening and polymerization (Ullmann's Encyclopädie der technischen Chemie, Vol. 19 (1980), Verlag Chemie, Weinheim, pages 31–38). Within the stated molecular weight range, the polyethylene glycols having various molecular weights may be used in admixture as block A. It is also possible to use polyethylene glycols having molecular weights of 62 to less than 450 in small quantities, preferably in quantities of 0.01 to 20% by weight, based on the total quantity of polyethylene glycol. The absence of polyethylene glycol components having molecular weights below 450 is an advantage so far as the emulsifiability of the block copolyesters is concerned. However, if non-crystalline block copolyesters liquid at room temperature are required, it is advisable to use polyethylene glycols having the low molecular weights in the stated quantities.

Hydrophobic diols selected from the group consisting of polypropylene glycols, polytetrahydrofurans, polycaprolactone diols, hydrogenation products of ricinoleic acid ester, 1,2-alkanediols, α,ω-alkanediols and/or dimeric diols are used as block B in the synthesis of the block copolyesters present in accordance with the invention. Polypropylene glycols are commercially available products and, on an industrial scale, are produced with any molecular weights analogously to the polyethylene glycols by polymerization in the presence of bases as catalysts. To ensure that the spinning finishes according to the invention have good lubricating properties, it is of advantage to use polypropylene glycols having weight average molecular weights in the range from 400 to 8,000 and preferably in the rang( from 600 to 4,000 although propylene glycol, dipropylene glycol or polypropylene glycols having weight average molecular weights o up to 400 may also be tolerated in quantities of 0.01 20% by weight, based on the total quantity of hydrophobic diols.

Polytetrahydrofurans are also commercially available products and may be obtained by ring-opening polymerization of tetrahydrofuran (see Ullmann's Encyclopädie der technischen Chemie, Vol. 19 (1980), Verlag Chemie, Weinheim, pages 297–299). Suitable polytetrahydrofurans have a weight molecular weight in the range from 200 to 8,000 and preferably in the range from 800 to 6,000. Polycaprolactone diols are also commercially available products and may be obtained by ring-opening polymerization of ε-caprolactone with aliphatic and/or aromatic diols, for example by the so-called Interox process in the presence of Lewis acids or organic acids as catalysts at temperatures in the range from 20° C. to about 150° C. Polycaprolactone diols which have been produced by ring-opening polymerization with aliphatic α,ω-diols containing 2 to 36 carbon atoms, preferably linear, saturated aliphatic diols containing 2 to 22 carbon atoms, are preferably used by virtue of their biodegradability. In principle, however, it is possible to use any polycaprolactone diols having weight average molecular weights of 400 to 4,000.

Hydrogenation products of ricinoleic acid ester are marketed by Applicants under the name of Loxanol®. They are diols obtained by complete hydrogenation of ricinoleic acid ester, preferably ricinoleic acid methyl ester.

For reasons of biodegradability, the 1,2-alkanediols suitable as hydrophobic diols are preferably aliphatic, saturated 1,2-alkanediols, more particularly unbranched types. 1,2-Alkanediols such as these are readily obtain able, for example by acid-catalyzed ring opening of terminally epoxidized alkanes with water (see Ullmann's Encyclopädie der technischen Chemie, Vol. 7 (1980), Verlag Chemie, Weinheim, pages 227–235). Aliphatic, saturated unbranched 1,2-alkanediols containing 2 to 24 carbon atoms such as octane-1,2-diol, decane-1,2-diol, dodecane-1,2-diol, tetradecane-1,2-diol, hexadecane-1,2-diol, octadecane-1,2-diol and/or technical mixtures thereof, are preferred.

α,ω-Alkanediols have two terminal hydroxyl groups and, can be obtained by hydrogenation of the corresponding dicarboxylic acids of which the preparation is described hereinafter. Aliphatic, saturated, unbranched α,ω-alkanediols are preferred, again for reasons of biodegradability. In this hydrophobic group, good lubricating properties are observed with α,ω-alkanediols containing 6 to 22 carbon atoms. Octane-1,8-diol, decane-1,10-diol, dodecane-1,12-diol, tetradecane-1,14-diol, hexadecane-1,16-diol, octadecane-1,18-diol and/or technical mixtures thereof are particularly preferred.

The dimeric diols, which may also be used as the hydrophobic diols, may be prepared by hydrogenation of dimeric fatty acids and/or esters thereof in accordance with DE-AS DE-B-17 68 313. Suitable adducts are polymerization products of monofunctional, mono- and/or polyunsaturated fatty acids and/or esters thereof which, if desired, may contain saturated components in small quantities. Suitable polymerization products are derived from oleic acid, linoleic acid, linolenic acid, palmitoleic acid, elaidic acid and/or erucic acid and/or esters of the above-mentioned fatty acids and lower aliphatic alcohols, and/or fatty acid mixtures obtained from tallow, olive oil, sunflower oil, soybean oil or cottonseed oil. Dimeric alcohols containing 24 to 36 carbon atoms obtainable b) hydrogenation of dimer fatty acids based on unsaturated fatty acids containing 12 to 18 carbon atoms are particularly suitable.

Mixtures of the hydrophobic diols listed above may o course also be used for the synthesis of the block copolyesters. Favorable properties are obtained if the hydrophobic diols are selected from the group of polypropylene glycols having a molecular weight of 400 to 8,000, polytetrahydrofurans having a molecular weight of 200 to 8,000, polycaprolactone diols having a molecular weight of 400 to 4,000, hydrogenation products of ricinoleic acid esters, α,ω-aliphatic alkanediols containing 6 to 22 carbon atoms and/or dimeric diols containing 24 to 36 carbon atoms. Preferred hydrophobic diols are the above-described polypropylene glycols having molecular weights of 400 to 8,000 and/or polytetrahydrofurans having molecular weights of 200 to 8,000 and, more particularly, polypropylene glycols having molecular weights of 400 to 8,000 used on their own. Where low-viscosity block copolyesters are required, it is of advantage to mix the hydrophilic and hydrophobic diols (blocks A and B) with monofunctional alcohols, preferably with monofunctional aliphatic saturated alcohols containing 1 to 22 carbon atoms, in quantities of 0.01 to 20 mol-%, based on the total quantity of diol.

For the synthesis of the block copolyesters, the hydrophilic polyethylene glycols are attached to the hydrophobic diols (block B) via ester groups by aliphatic dicarboxylic acids containing 2 to 36 carbon atoms, anhydrides thereof, esters of the aliphatic dicarboxylic acids with lower alcohols containing 1 to 8 carbon atoms and/or carbonic acid diesters of lower alcohols containing 1 to 8 carbon atoms.

Aliphatic dicarboxylic acids may be obtained, for example, by oxidative degradation of higher monocarboxylic acids or even by carbonylation. A review of production methods with literature references can be found in Ullmann's Encyclopädie der technischen Chemie, Vol. 10 (1980), Verlag Chemie, Weinheim, pages 135–143. Carbonic acid esters may be prepared by the processes mentioned in Houben-Weyl, "Methoden der organischen Chemie", 4th Edition, Vol. E4, pages 66 et seq. Carbonic acid diesters of lower alcohols containing 1 to 8 carbon atoms, such as dimethyl, di-n-propyl, diisopropyl and/or di-2-ethylhexyl carbonate are suitable for transesterification. Of the aliphatic dicarboxylic acids, saturated α,ω-dicarboxylic acids containing 2 to 36 carbon atoms, such as oxalic acid, malonic acid, succinic acid, glutaric acid, adipic acid, pimelic acid, suberic acid, azelaic acid, sebacic acid, brassylic acid, thapsic acid, phellogenic acid and/or tetratriacontanedioic acid are preferred. Anhydrides and/or esters, preferably esters of lower alcohols containing 1 to 8 carbon atoms, may of course also be used instead of or in admixture with the α,ω-dicarboxylic acids mentioned above. Dimer fatty acids may also be used instead of or in admixture with the preferred α,ω-dicarboxylic acids for connecting the blocks A and B. As already mentioned, dimer fatty acids are obtained by polymerization of mono- and/or polyunsaturated fatty acids and/or esters thereof which, if desired, may also contain saturated components in addition to unsaturated components in the presence of bases as catalysts. Although not preferred on account of their branched structure, dimer fatty acids based on oleic acid, linoleic acid, linolenic acid, palmitoleic acid, elaidic acid and/or erucic acid may be used. In a particularly preferred embodiment, the blocks A) and B) are preferably joined by aliphatic α,ω-dicarboxylic acids containing 2 to 36 carbon atoms, esters of aliphatic α,ω-dicarboxylic acids containing 2 to 36 carbon atoms and lower alcohols containing 1 to 8 carbon atoms and/or anhydrides of the aliphatic α,ω-dicarboxylic acids containing 2 to 36 carbon atoms. The above-mentioned carbonic acid diesters, aliphatic dicarboxylic acids, anhydrides and/or esters thereof may be provided with aromatic dicarboxylic acids, such as phthalic acid, terephthalic acid and/or isophthalic acid, in quantities of 0.01 to 25 mol %, based on aliphatic dicarboxylic acids, although this does have an adverse effect on their biodegradability.

Where low-viscosity block copolyesters are required, it is possible—in the same way as with the diols—to add monofunctional aliphatic carboxylic acids containing 1 to 22 carbon atoms in quantities of 0.01 to 20 mol-%, based on dicarboxylic acid.

In particularly preferred spinning finishes, the lubricant is a block copolyester prepared from A) polyethylene glycols having a molecular weight of 600 to 3,000 and preferably 800 to 2,000 and B) hydrophobic diols selected from the group of polypropylene glycols having a molecular weight of 400 to 8,000, polytetrahydrofurans having a molecular weight of 200 to 8,000, polycaprolactone diols having a molecular weight of 400 to 4,000, hydrogenation products of ricinoleic acid esters, aliphatic α,ω-alkanediols containing 2 to 24 carbon atoms and aliphatic α,ω-dicarboxylic acids containing 2 to 36 carbon atoms connecting the blocks A) and B), anhydrides thereof and/or esters thereof with lower alcohols containing 1 to 8 carbon atoms.

Of these spinning finishes, those in which the lubricant is a block copolyester where B) represents hydrophobic diols selected from the group of polypropylene glycols having a molecular weight of 400 to 8,000 and polytetrahydrofurans having a molecular weight of 200 to 8,000, more particularly polypropylene glycols having a molecular weight of 400 to 8,000, are most particularly preferred.

The spinning finishes according to the invention contain block copolymers as lubricants, both the lubricating properties and the emulsifiability of the lubricants being co-determined by the ratio by weight between the hydrophilic block A and the hydrophobic block B. Adequate lubricating properties are still observed where the ratio by weight between the blocks A and B is from 90:10 to 1:99. Increasing quantities of hydrophilic polyethylene glycols improve the emulsifiability of the lubricants. Readily emulsifiable block copolyesters are obtained with ratios by weight between the blocks A and B of 20:80.

The molecular weight and degree of polymerization of the block copolyesters is determined above all by the molar ratios of the hydroxyl groups of the diols (OH) to the carboxyl groups of the dicarboxylic acids, their anhydrides, esters and/or carbonic acid diesters (COOH). Adequate molecular weights are obtained if the molar ratios of hydroxyl groups to carboxyl groups OH:COOH are in the range from 3:1 to 1:3 and preferably in the range from 1.5:1 to 1:1.5. Higher molecular weights of the block copolyesters are preferred, so that molar ratios of OH to COOH of 1.2:1 to 0.8:1 are recommended.

The spinning finishes according to the invention may contain other lubricants known from the prior art in admixture with the described block copolyesters as lubricants, including mineral oils, fatty acid esters containing 8 to 22 carbon atoms in the fatty acid part and 1 to 22 carbon atoms in the alcohol part, for example palmitic acid methyl ester, isobutyl stearate and/or tallow fatty acid 2-ethylhexyl ester, polyol carboxylic acid esters, for example coconut oil fatty acid esters of glycerol and/or alkoxylated glycerols, silicones, for example dimethyl polysiloxane, and/or polyalkylene glycols, for example ethylene oxide/propylene oxide copolymers (Chemiefasern, Textil-Industrie, 1977, page 335). In addition to the lubricants, the spinning finishes according to the invention may contain emulsifiers, wetting agents and/or antistatic agents and, optionally, standard auxiliaries, such as pH regulators, filament compacting agents, bactericides and/or corrosion inhibitors. Suitable emulsifiers, wetting agents and/or antistatic agents are anionic, cationic and/or nonionic surfactants, such as mono- and/or diglycerides, for example glycerol mono- and/or dioleate, alkoxylated, preferably ethoxylated and/or propoxylated, fats, oils, fatty alcohols containing 8 to 24 carbon atoms and/or $C_{8-18}$ alkylphenols, for example castor oil containing 25 mol ethylene oxide (EO) and/or $C_{16-18}$ fatty alcohol containing 8 mol propylene oxide and 6 mol EO, if desired alkoxylated $C_{8-24}$ fatty acid mono- and/or diethanolamides, for example optionally ethoxylated oleic acid mono- and/or diethanolamide, tallow fatty acid mono- and/or diethanolamide and/or coconut oil fatty mono- and/or diethanolamide, alkali metal and/or ammonium salts of alkoxylated, preferably ethoxylated and/or propoxylated, optionally end-capped $C_{8-22}$ alkyl and/or $C_{8-22}$ alkylene alcohol sulfonates, reaction products of optionally alkoxylated $C_{8-22}$ alkyl alcohols with phosphorus pentoxide or phosphorus oxychloride in the form of their alkali metal, ammonium and/or amine salts, for example phosphoric acid esters of ethoxylated $C_{12-14}$ fatty alcohols, neutralized with alkanolamine, alkali metal and/or ammonium salts of $C_{8-22}$ alkyl sulfosuccinates, for example sodium dioctyl sulfosuccinate and/or amine oxides, for example dimethyl dodecyl amine oxide. In considering this list of examples, it is important to bear in mind that many of the substances mentioned can perform not just one function, but several functions. Thus, an antistatic agent may also act as an emulsifier.

Optional constituents may be the usual auxiliaries.

Suitable filament compacting agents are the polyacrylates, fatty acid sarcosides and/or copolymers with maleic anhydride known from the prior art (Melliand Textilberichte (1977), page 197) and/or polyurethanes according to DE-A-38 30 468, pH regulators, for example $C_{1-4}$ carboxylic acids and/or $C_{1-4}$ hydroxycarboxylic acids, such as acetic acid and/or glycolic acid, alkali metal hydroxides, such as potassium hydroxide, and/or amines, such as triethanolamide, bactericides and/or corrosion inhibitors.

The spinning finishes according to the invention are prepared by intensive mixing of the block copolyesters as lubricants and, optionally, other lubricants, emulsifiers, wetting agents, antistatic agents and/or standard auxiliaries at temperatures of 18 to 25° C.

As normal in the textile industry, the spinning finishes are applied to the synthetic filament fibers in the form of aqueous dispersions immediately the fibers leave the spinneret. The spinning finishes, which have a temperature of 18 to 16° C., are applied by applicator rolls or metering pumps in conjunction with suitable applicators. Spinning finishes in the form of aqueous dispersions having a total active substance content of 3 to 40% by weight and preferably 5 to 30% by weight are preferred. Based on their total active substance content, the spinning finishes according to the invention contain 35 to 100% by weight lubricants, 0 to 65% by weight emulsifiers, antistatic agents and/or wetting agents, 0 to 10% by weight pH regulators, bactericides and/or corrosion inhibitors, the quantities having to be selected so that they add up to 100% by weight. The lubricants mentioned in this list include the described block copolyesters and the lubricants known from the prior art, with the proviso that at least 50% by weight, preferably 75 to 100% by weight and, more preferably, 100% by weight of the lubricants are block copolyesters.

The quantity in which the spinning finishes are applied in the form of aqueous dispersions lies within the normal limits for the textile industry of 0.1 to 3% by weight, based on the weight of the filament fibers. The synthetic filament fibers of polypropylene, polyester and/or polyamide either as such or even in admixture are provided with the spinning finishes according to the invention. The spinning finishes according to the invention provide the synthetic filament fibers with the necessary surface-slip properties. The spinning finishes according to the invention also show sufficiently high thermal stability during texturing of the synthetic filament fibers, so that very few, if any, unwanted deposits are observed on the filament fibers and/or the texturing elements. Crimping of the synthetic filament fibers treated with the spinning finishes according to the invention is also readily possible and remains stable. However, the spinning finishes according to the invention show particular advantages above all in their improved biodegradability.

The present invention also relates to the use of block copolyesters prepared from the blocks A) polyethylene glycols having a molecular weight of 450 to 20,000 and B) hydrophobic diols selected from the group of polypropylene glycols, polytetrahydrofurans, polycaprolactone diols, hydrogenation products of ricinoleic acid esters, 1,2-alkanediols, α,ω-alkanediols and/or dimeric diols and aliphatic dicarboxylic acids containing 2 to 36 carbon atoms connecting the blocks A) and B), anhydrides thereof, esters thereof with lower alcohols containing 1 to 8 carbon atoms and/or carbonic acid diesters of lower alcohols containing 1 to 8 carbon atoms as lubricants in spinning finishes for synthetic filament fibers.

Particulars of the block copolyesters used, optionally in admixture with other lubricants, emulsifiers, wetting agents, antistatic agents and/or standard auxiliaries, can be found in the foregoing in the same way as can details of the quantities in which the block copolyesters are used and the methods by which they are applied.

EXAMPLES

A. Preparation of the block copolyesters

Examples 1a–1d (Step-by-step condensation with anhydrides)

In a three-necked flask equipped with a stirrer, reflux condenser, water separator and nitrogen inlet pipe, 902 g polypropylene glycol (average molecular weight 1,000) were stirred for 1 hour at 150° C. with 1a) 84.6 g succinic anhydride
1b) 91.7 g succinic anhydride
1c) 78.6 g succinic anhydride
1d) 104.8 g succinic anhydride.

0.25 g tin(II) octoate as esterification catalyst, 220 g polyethylene glycol (average molecular weight 1,000) and 100 ml xylene were then added under nitrogen, followed by slow heating to 200 to 220° C. The water formed was azeotropically distilled off until the block copolyester had a residual acid value of 1a) 3
1b) 4.2
1c) 3.8
1d) 6.0.

Finally, xylene was removed in vacuo. Wax-like, self-emulsifiable block copolyesters were obtained.

Examples 2a and 2b (One-pot condensation with dicarboxylic acid)

In a three-necked flask equipped in the same way as in Example 1, 902 g polypropylene glycol (MW 1,000), 220 g polyethylene glycol (MW 1,000), 0.25 g tin(II) octoate, 100 ml xylene and 92.7 g succinic acid (Example 2A) or 114.7 g adipic acid (Example 2B) were slowly heated with stirring under nitrogen to 200° C. The water was azeotropically distilled off until the block copolyester had a residual acid value of 2 (Example 1A) or 2.9 (Example 2B). A wax-like self-emulsifiable block copolyester was obtained after removal of the xylene.

Example 3

225 g polypropylene glycol (MW 1,000), 100 g succinic anhydride, 0.25 g tin(II) octoate, 880 g polyethylene glycol (MW 1,000) and 100 ml xylene were reacted as in Example 1. The water was distilled off azeotropically until the block copolyester had a residual acid value of 6. A wax-like block copolyester with an opalescent appearance in the form of a 10% by weight solution in water was obtained.

Example 4

840 g polytetrahydrofuran (average molecular weight 1,000), 100 g succinic anhydride, 0.25 g tin(II) octoate, 210 g polyethylene glycol (MW 1,000) and 100 ml xylene were reacted as in Example 1. Water then azeotropically distilled off until the block copolyester had a residual acid value of 7.5. A wax-like block copolyester was obtained after removal of the xylene.

To prepare an aqueous dispersion, 10 g of the block copolyester were dissolved in 30 g isopropanol and 60 g water were stirred into the resulting solution. A fine-particle, stable dispersion was obtained.

Example 5

525 g decane-1,10-diol, 292 g succinic anhydride, 0.25 g tin(II) octoate, 225 g polyethylene glycol (MW 1,000) and 100 ml xylene were reacted as in Example 1. 51 ml water were then azeotropically distilled off until the block copolyester had a residual acid value of 3. The block copolyester could be emulsified in water after melting and heating to 50° C.

Example 6

In a three-necked flask equipped with a stirrer, reflux condenser, water separator and nitrogen inlet, 902 g polypropylene glycol (MW 1,000), 118 g diethyl carbonate, 220 g polyethylene glycol (MW 1,000) and 1.2 g transesterification catalyst (Swedcat 5, a product of Swedstab) were slowly heated with stirring under nitrogen to 200° C. over a period of 6 hours and ethanol was distilled off until no more condensate was formed. 77 ml ethanol (67% of the theoretical quantity) were collected as distillate in this way. A wax-like block copolyester was obtained and formed a fine-particle dispersion in water. To this end, 10% by weight block copolyester are dispersed with 90% by weight water.

B. Application Examples

A 7.5% by weight spinning finish of block copolyesters of the various Examples in water was applied (oil coating 0.35% by weight) to polyester filaments (yarn type: pre-oriented yarn PES; fineness dtex 167, filament count: f 34; spinning rate 3,300 m/minute).

The following parameters were determined:

dynamic friction coefficient against ceramic at speeds of 2 and 200 m/minute, as measured with a Rothschild F Meter (at 20° C/65% relative air humidity)

electrostatic charging on ceramic at speeds of 2 and 200 m/minute, as measured with an Eltex inductive voltmeter (at 20° C/65% relative air humidity)

stick/slip, as measured with a Rothschild F Meter (looping: 3 mm/min.: 20), of the stretched and unstretched filament crimp contraction as measured with a Tex-Techno on Texto-Mat M the heater and disk evaluation of the texturizing elements (Barmag texturing machine; heater M-Type; ceramic disks arrangement 1-7-1 at 220° C.) was carried out by subjective marking (1=very good, 6=poor)

thermal stability measured as weight loss by thermogravimetric analysis (TGA) in %—Thermal Analyst with a DuPont TGA 951 thermobalance—and as oxidative decomposition by differential scanning calorimetry (DSC) in ° C.—Thermal Analyst 2100 with a DuPont model 910 DSC biodegradability as determined by the "Closed Bottle Test" according to Dr. Fischer, Fette-Seifen-Anstrich-mittel No. 1 (1963), pages 37–42.

As can be seen from Table 1, spinning finishes containing the block copolyester according to the invention are comparable with commercially available finishes in their lubricating properties, stick/slip values, crimp contraction and heater and disk evaluations. Although the electrical charging values are somewhat poorer, they are still in acceptable ranges which can be raised to the required level by additions of antistatic agents. Their thermal stability (see Table 2) also corresponds to the stringent requirements of fiber manufacturers. The block copolyesters are clearly superior in their biodegradability to commercially available products (see Table 3).

TABLE 1

Properties of the texturized yarn

| Lubricant acc. to | Dynam. friction coefficient (mue) 2 m/min. | Dynam. friction coefficient (mue) 200 m/min. | Electrostatic charging 2 m/min. | Electrostatic charging 200 m/min/ | Crimping in % | Heater mark | Disks mark | Stick/slip in cN |
|---|---|---|---|---|---|---|---|---|
| Ex. 1 c | 0.210 | 0.416 | −5.5 | −16.00 | 9.80 | 2.5 | 3.5 | 4.5 |
| Ex. 2 b | 0.193 | 0.409 | 0.32 | −13.80 | 12.74 | 3.5 | 3.0 | 5.0 |
| Comparison* | 0.207 | 0.412 | −3.9 | −1.9 | 13.21 | 3.5 | 4.5 | 8 |

*Comparison = 7.5% by weight spinning finish, lubricant: random copolymer of trimethyl propane containing 18 mol EO and 28 mol PO

TABLE 2

Thermal stability of the pure block copolyesters

| Lubricant | Oxidat. Decomposition DSC at ° C. | Weight loss by TGA at 240° C. in % |
|---|---|---|
| Comparison* | 133 | 24 |
| Ex. 2 b | 141 | 35 |
| Ex. 1 d | 132 | 23 |
| Ex. 1 c | n.d. | 30 |

*Trimethylol propane · 18 EO · 28 PO

TABLE 3

Biodegradability of the pure block copolyesters

| | Degradability |
|---|---|
| Ex. 1 c | 30% |
| Ex. 3 | >80% |
| Ex. 4 | 33% |
| Ex. 6 | 30% |
| Comparison: Pluronic L 64, block copolyether containing 60% by weight PO and 40% by weight EO units, MW 2,900 | 0% |

What is claimed is:

1. A spinning finish composition for synthetic filament fibers containing a lubricant component having improved biodegradability, said lubricant component consisting of a block copolyester prepared from the blocks A) and B) wherein block A) consists of a hydrophilic polyethylene glycol having a weight average molecular weight of 450 to 20,000, block B) consists of a hydrophobic diol selected from the group consisting of polypropylene glycols, polytetrahydrofurans, polycaprolactone diols, hydrogenation products of ricinoleic acid esters, and dimeric diols, and wherein said block A) and said block B) are interconnected with aliphatic $C_{2-36}$ dicarboxylic acids, anhydrides thereof, or esters thereof with lower $C_{1-8}$ alcohols, or carbonic acid diesters of lower $C_{1-8}$ alcohols.

2. A spinning finish composition as in claim 1 wherein said block A) and said block B) are interconnected with aliphatic α,ω-dicarboxylic acids containing 2 to 36 carbon atoms, esters of aliphatic α,ω-dicarboxylic acids containing 2 to 36 carbon atoms and lower alcohols containing 1 to 8 carbon atoms, or anhydrides of the aliphatic α,ω-dicarboxylic acids containing 2 to 36 carbon atoms.

3. a spinning finish composition as in claim 1, wherein said block B) is selected from the group consisting of polypropylene glycols having a weight average molecular weight of 400 to 8,000, polytetrahydrofurans having a weight average molecular weight of 200 to 8,000, polycaprolactone diols having a weight average molecular weight of 400 to 4,000, hydrogenation products of ricinoleic acid esters, and dimeric diols containing 24 to 36 carbon atoms.

4. A spinning finish composition as in claim 1 wherein said block B) consists of a polypropylene glycol having a weight average molecular weight of 600 to 4,000.

5. A spinning finish composition as in claim 1 wherein said block copolyester has been prepared from block A) and block B) wherein block A) consists of a hydrophilic polyethylene glycol having a weight average molecular weight of 600 to 3,000, block B) consists of a hydrophobic diol selected from the group consisting of polypropylene glycols having a weight average molecular weight of 400 to 8,000, polytetrahydorfurans having a weight average molecular weight of 200 to 8,000, polycaprolactone diols having a weight average molecular weight of 400 to 4,000, and hydrogenation products of ricinoleic acid esters, and wherein said block A) and said block B) are interconnected with aliphatic α,ω-dicarboxylic acids containing 2 to 36 carbon atoms, anhydrides thereof, or esters thereof with lower alcohols containing 1 to 8 carbon atoms.

6. A spinning finish composition as in claim 1 wherein the interconnecting dicarboxylic acids, anhydrides thereof, or esters thereof with lower $C_{1-8}$ alcohols, or carbonic acid diesters of lower $C_{1-8}$ alcohols have a molar ratio of OH to COOH of 3:1 to 1:3.

7. A spinning finish composition as in claim 1 wherein said block A) and said block B) are present in a weight ratio of 90:10 to 1:99.

8. A spinning finish composition as in claim 1 wherein said lubricant component is present in an amount of from 35 to 100% by weight, based on the weight of said composition.

9. The process of lubricating a synthetic filament fiber comprising contacting said filament fiber with a spinning finish composition containing a lubricant component having Improved biodegradability, said lubricant component consisting of a block copolyester prepared from the blocks A) and B) wherein block A) consists of a hydrophilic polyethylene glycol having a weight average molecular weight of 450 to 20,000, block B) consists of a hydrophobic diol selected from the group consisting of polypropylene glycols, polytetrahydrofurans, polycaprolactone diols, hydrogenation products of ricinoleic acid esters, and dimeric diols, and wherein said block A) and said block B) are interconnected with aliphatic $C_{2-36}$ dicarboxylic acids, anhydrides thereof, or esters thereof with lower $C_{1-8}$ alcohols, or carbonic acid diesters of lower $C_{1-8}$ alcohols.

10. A process according to claim 9 wherein said block A) and said block B) are interconnected with aliphatic α,ω-dicarboxylic acids containing 2 to 36 carbon atoms, esters of aliphatic α,ω-dicarboxylic acids containing 2 to 36 carbon atoms and lower alcohols containing 1 to 8 carbon atoms, or anhydrides of the aliphatic α,ω-dicarboxylic acids containing 2 to 36 carbon atoms.

11. A process according to claim 9 wherein said block B) is selected from the group consisting of polypropylene glycols having a weight average molecular weight of 400 to 8,000, polytetrahydrofurans having a weight average molecular weight of 200 to 8,000, polycaprolactone diols having a weight average molecular weight of 400 to 4,000, hydrogenation products of ricinoleic acid esters, and dimeric diols containing 24 to 36 carbon atoms.

12. A process according to claim 9 wherein said block B) consists of a polypropylene glycol having a weight average molecular weight of 600 to 4,000.

13. A process according to claim 9 wherein said block copolyester has been prepared from block A) and block B) wherein block A) consists of a hydrophilic polyethylene glycol having a weight average molecular weight of 600 to 3,000, block B) consists of a hydrophobic diol selected from the group consisting of polypropylene glycols having a weight average molecular weight of 400 to 8,000, polytetrahydrofurans having a weight average molecular weight of 200 to 8,000, polycaprolactone diols having a weight average molecular weight of 400 to 4,000, and hydrogenation products of ricinoleic acid esters, and wherein said block A) and said block B) are interconnected with aliphatic α,ω-dicarboxylic acids containing 2, to 36 carbon atoms, anhydrides thereof, or esters thereof with lower alcohols containing 1 to 8 carbon atoms.

14. A process according to claim 9 wherein the interconnecting dicarboxylic acids, anhydrides thereof, or esters thereof with lower $C_{1-8}$ alcohols or carbonic acid diesters of lower $C_{1-8}$ alcohols have a molar ratio of OH to COOH of 3:1 to 1:3.

15. A process according to claim 9 wherein said block A) and said block B) are present in a weight ratio of 90:10 to 1:99.

16. A process according to claim 9 wherein said lubricant component is present in an amount of from 35 to 100% by weight, based on the weight of said composition.

17. A process according to claim 9 wherein said spinning finish composition is applied to said filament fiber in the amount of from 0.1 to 3% by weight, based on the weight of said filament fiber.

18. A process according to claim 9 wherein said filament fiber is selected from the group consisting of polypropylene, polyester, and polyamide.

* * * * *